US007053835B2

(12) United States Patent
Noro et al.

(10) Patent No.: US 7,053,835 B2
(45) Date of Patent: May 30, 2006

(54) ANTENNA UNIT HAVING A NON-FEEDING CONDUCTOR WALL SO AS TO ENCLOSE A PATCH ANTENNA

(75) Inventors: Junichi Noro, Akita (JP); Takeshi Iizuka, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/928,218

(22) Filed: Aug. 27, 2004

(65) Prior Publication Data

US 2005/0099338 A1 May 12, 2005

(30) Foreign Application Priority Data

Nov. 6, 2003 (JP) ..... 2003-376488

(51) Int. Cl.
*H01Q 1/38* (2006.01)
*H01Q 1/42* (2006.01)

(52) U.S. Cl. ..... 343/700 MS; 343/789

(58) Field of Classification Search ..... 343/700 MS, 343/789, 702, 841, 846; H01Q 1/38, 1/42
See application file for complete search history.

(56) References Cited

U.S. PATENT DOCUMENTS

| | | | | |
|---|---|---|---|---|
| 4,415,900 | A * | 11/1983 | Kaloi | 343/700 MS |
| 6,008,772 | A * | 12/1999 | Legay et al. | 343/787 |
| 6,731,243 | B1 * | 5/2004 | Taira et al. | 343/700 MS |
| 6,756,942 | B1 * | 6/2004 | Heyde | 343/700 MS |

FOREIGN PATENT DOCUMENTS

| | | | |
|---|---|---|---|
| JP | 7-94934 | A | 4/1995 |
| JP | 2002-26649 | A | 1/2002 |
| JP | 2003-163521 | A | 6/2003 |

* cited by examiner

*Primary Examiner*—Hoanganh Le
(74) *Attorney, Agent, or Firm*—Frishauf, Holtz, Goodman & Chick, P.C.

(57) ABSTRACT

In an antenna unit including a patch antenna, the antenna unit is provided with a non-feeding conductor wall so as to enclose the patch antenna. The conductor wall is, for example, made of metal. The conductor wall has a square main conductor plate apart from a bottom surface of the patch antenna, four side plates extending upward from four sides of the main conductor plate, and four trapezoidal tongue pieces extending inward from upper ends of the four side plates in parallel with the main conductor plate.

4 Claims, 5 Drawing Sheets

SAT

| deg | Ave. [dBi] | Max. [dBi] | Min. [dBi] |
|---|---|---|---|
| 20 | −0.62 | 0.63 | −2.47 |
| 25 | 0.27 | 1.44 | −1.49 |
| 30 | 1.06 | 2.13 | −0.45 |
| 35 | 1.88 | 2.86 | 0.48 |
| 40 | 2.56 | 3.45 | 1.29 |
| 45 | 3.22 | 4.07 | 2.01 |
| 50 | 3.74 | 4.55 | 2.61 |
| 55 | 4.23 | 5.02 | 3.15 |
| 60 | 4.64 | 5.37 | 3.62 |

TER

| Ave. [dBi] | Max. [dBi] | Min. [dBi] | Max.−Min.[dBi] |
|---|---|---|---|
| −3.29 | −2.52 | −4.79 | 2.27 |

FIG. 6

SAT

| deg | Ave. [dBi] | Max. [dBi] | Min. [dBi] |
|---|---|---|---|
| 20 | 0.30 | 1.61 | −1.56 |
| 25 | 1.06 | 2.28 | −0.62 |
| 30 | 1.77 | 2.87 | 0.30 |
| 35 | 2.46 | 3.49 | 1.29 |
| 40 | 3.05 | 3.99 | 2.02 |
| 45 | 3.51 | 4.40 | 2.60 |
| 50 | 3.83 | 4.63 | 2.98 |
| 55 | 4.02 | 4.81 | 3.23 |
| 60 | 4.10 | 4.76 | 3.38 |

TER

| Ave. [dBi] | Max. [dBi] | Min. [dBi] | Max.−Min.[dBi] |
|---|---|---|---|
| −1.83 | −0.38 | −2.90 | 2.52 |

FIG. 7

SAT

| deg | Ave. [dBi] | Max. [dBi] | Min. [dBi] |
|---|---|---|---|
| 20 | 0.31 | 1.78 | −1.62 |
| 25 | 1.00 | 2.24 | −0.68 |
| 30 | 1.74 | 2.87 | 0.27 |
| 35 | 2.36 | 3.32 | 1.00 |
| 40 | 2.95 | 3.92 | 1.67 |
| 45 | 3.33 | 4.20 | 2.06 |
| 50 | 3.68 | 4.54 | 2.53 |
| 55 | 3.84 | 4.63 | 2.75 |
| 60 | 3.91 | 4.64 | 2.96 |

TER

| Ave. [dBi] | Max. [dBi] | Min. [dBi] | Max.−Min.[dBi] |
|---|---|---|---|
| −1.75 | −0.84 | −2.99 | 2.15 |

FIG. 8

ANTENNA UNIT HAVING A NON-FEEDING CONDUCTOR WALL SO AS TO ENCLOSE A PATCH ANTENNA

This application claims priority to prior Japanese patent application JP 2003-376488, the disclosure of which is incorporated herein by reference.

BACKGROUND OF THE INVENTION

This invention relates to an antenna unit including a patch antenna and, in particular, to an antenna unit including a patch antenna which is used as an antenna for use in a digital radio receiver for receiving an electric wave from an artificial satellite (that may be called a "satellite wave") or an electric wave on the ground (that may be called a "terrestrial wave") to listen in a digital radio broadcasting.

In recent years, a digital radio receiver, which receives the satellite wave or the terrastrial wave to listen the digital radio use in the United States of America. The digital radio receiver is mounted on a mobile station such as an automobile and can receive an electric wave having a frequency of about 2.3 gigahertz (GHz) to listen in a radio broadcasting. That is, the digital receiver is a radio receiver which can listen in a mobile broadcasting. Inasmuch as the received wave has the frequency of about 2.3 GHz, a reception wavelength (resonance frequency) l thereof is equal to about 128.3 mm. In addition, the terrestrial wave is an electric wave in which a signal where the satellite wave is received in an earth station is frequency shifted a little.

Inasmuch as the electric wave having the frequency of about 2.3 GHz is used in the digital radio broadcasting in the manner which is described above, it is necessary to set up an antenna outside the automobile. Accordingly, the antenna must be attached to a roof of the automobile in a case where the digital radio receiver is mounted in the automobile.

It is necessary for the antennas of the type described to have a wide directivity. This is because it is necessary for the digital radio receiver to receive, from the artificial satellite, the satellite wave having a relatively low angle of elevation which laid in a range of 20 degrees and 60 degrees. In addition, the terrestrial wave has an angle of elevation which is substantially equal to zero degree.

In general, it is understood that antennas of planer-type (plane-type) such as patch antennas are unsuited for the antenna for use in the digital radio receiver because the antennas of planer-type (plane-type) has a narrow directivity. However, even a patch antenna, it is known that it is possible for the patch antenna to widen a directivity of an antenna by using a ground (earth) plate having a wide area (see, e.g. JP 2003-163521 A).

Particularly, in a case where the digital radio receiver is mounted in the automobile, its antenna is attached to the roof of the automobile in the manner which is described above. In this event, inasmuch as the roof of the automobile serves as the ground plate in itself, it is confirmed that it is possible for the patch antenna to sufficiently use the antenna for the digital radio receiver.

On the other hand, there is a demand to listen in the digital radio broadcasting not only in the inside of the automobile but also, for example, from a portable audio apparatus such as a compact disc (CD) radio-cassette recorder. In order to reply the demand, it is proposed to mount the patch antenna in a lid which is arranged on a top surface of a casing in the portable audio apparatus and which is openable for taking an optical disk into and out from the portable audio apparatus.

In this event, it is necessary to provide with the ground plate (earth plate) under the patch antenna.

In the manner which is described above, it is necessary for the patch antenna to use the ground plate having a large area in order to gain the directivity of the antenna in the low angle of elevation. However, it is difficult for the above-mentioned portable audio apparatus to be provide with the ground plate (earth plate) having a wide area. Accordingly, an antenna unit having the directivity of the antenna which is not degraded in the low angle of elevation is desired in a case of using the ground plate (earth plate) having a narrow area.

In addition, a planar antenna is known. The planar antenna comprises a circuit substrate having an upper surface and a bottom surface, a patch antenna mounted on the upper surface of the circuit substrate, circuit elements such as a low noise amplifier (LNA) and so on mounted on the bottom surface of the circuit substrate, a shield cover, attached to the bottom surface, for shielding the circuit elements (see, e.g. JP 2002-26649).

In addition, a compact plane patch antenna for use in a global positioning system (GPS) or the like (see, e.g. JP 07-094934 A). According to JP 07-094934 A, the compact plane patch antenna has high infrequency temperature characteristics and high reliability by using magnesium titanate ceramic having comparatively high dielectric constant as a main material for a dielectric material and adding the proper quantity of lithium niobate, alumina, manganese oxide, etc., individually or their combination at ions to the main material to mold the antenna.

SUMMARY OF THE INVENTION

It is therefore an object of the present invention to provide an antenna unit which is capable of ensuring a directivity of an antenna in a low angle of elevation in a case of using a ground plate (earth plate) having a narrow area.

Other objects of this invention will become clear as the description proceeds.

According to an aspect of this invention, an antenna unit comprises a patch antenna. The patch antenna comprises a dielectric having a top surface, a bottom surface, and a side surface, a radiation element formed on the top surface of the dielectric, and a ground conductor formed on the bottom surface of the dielectric. The antenna unit further comprises a non-feeding conductor wall apart from the side surface and the bottom surface of the dielectric to as to cover the side surface and the bottom surface of the dielectric.

In the antenna unit according to the aspect of this invention, the said conductor wall may be made of metal. The conductor wall may comprise a square main conductor plate apart from the bottom surface of the patch antenna, four side plates extending upward from four sides of the main conductor plate, and four trapezoidal tongue pieces extending inward from upper ends of the four side plates in parallel with the main conductor plate. Alternatively, the conductor wall may comprise a square main conductor plate apart from the bottom surface of the patch antenna, four side plates extending upward from four sides of the main conductor plate, and a ring-shaped top plate extending inward from upper ends of the four side plates in parallel with the main conductor plate.

BRIEF DESCRIPTION OF THE DRAWINGS

FIG. 6 shows an antenna radiation characteristic of a conventional antenna unit including only a patch antenna without a conductor wall FIG. 7 shows an antenna radiation characteristic of the antenna unit illustrated in FIGS. 1 through 3; and FIG. 8 shows an antenna radiation characteristic of the antenna unit illustrated in FIGS. 4 and 5.

DESCRIPTION OF THE PREFERRED EMBODIMENTS

Figure 1:
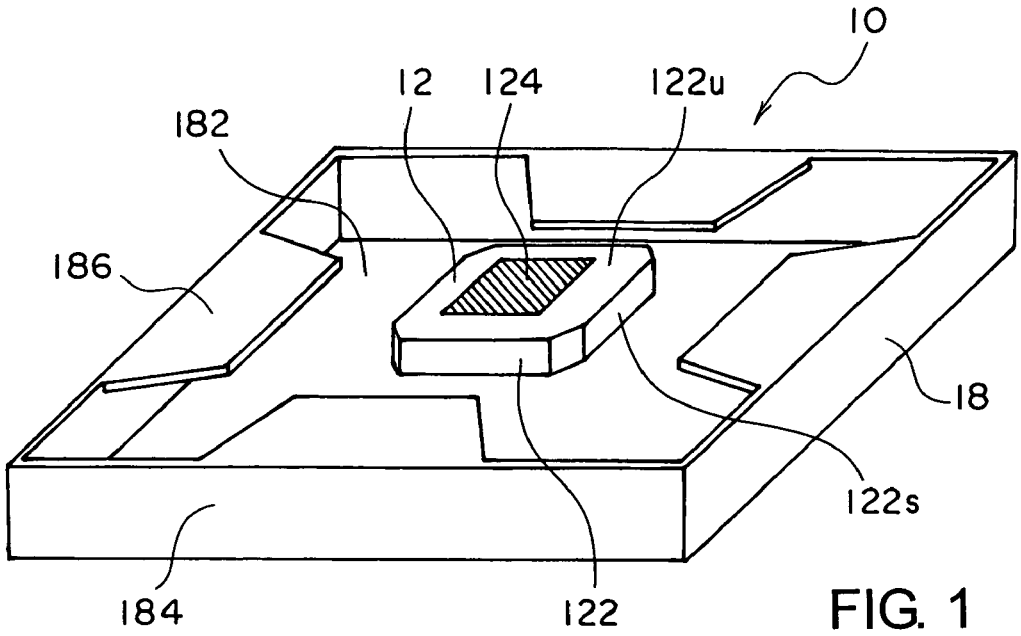
FIG. 1 is a perspective view of an antenna unit according to a first embodiment of this invention.
Figure 2:
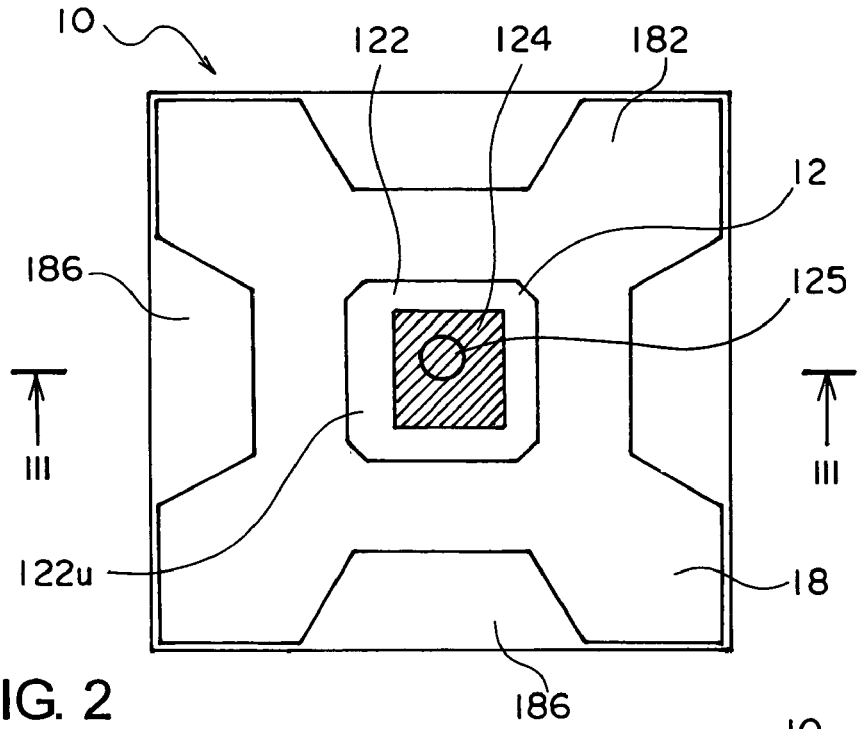
FIG. 2 is a plan view of the antenna unit illustrated in FIG. 1.
Figure 3:
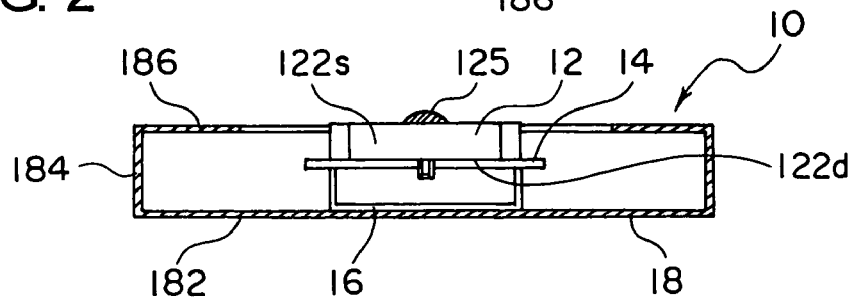
FIG. 3 is a section taken on line III—III in FIG. 2.

Referring to FIGS. 1, 2, and 3, the description will proceed to an antenna unit 10 according to a first embodiment of the present invention. FIG. 1 is a perspective view of the antenna unit 10. FIG. 2 is a plan view of the antenna unit 10. FIG. 3 is a section taken on line III—III in FIG. 2.

The antenna unit 10 includes an patch antenna 12. The patch antenna 12 has a well-known structure in the art. Specifically, the patch antenna 12 comprises a dielectric 122 having configuration of a substantially rectangular parallelepiped. In the example being illustrated, the dielectric 122 has a length, a width, and a thickness which are equal to 25 mm, 25 mm, and 4 mm, respectively. The dielectric 122 is made of a ceramic material or resin. The dielectric 122 has a top or upper surface 122*u*, a bottom surface 122*d*, and a side surface 122*s*. Practically, in the manner which is illustrated in FIGS. 1 and 2, the side surface 122*s* of the dielectric 122 has four corners which are chamfered.

On the upper surface 122*u* of the dielectric 122, a radiation element 124 is formed. On the bottom surface 122*d* of the dielectric 122, a ground conductor (not shown) is formed. The patch antenna 12 has a feeding point 125.

As shown in FIG. 3, the patch antenna 12 is mounted on an upper surface of a circuit substrate 14. The circuit substrate 14 has a bottom surface on which circuit elements (not shown) such as a low noise amplifier and so on are mounted. In order to shield the circuit elements, a shield cover 16 is attached to the bottom surface of the circuit substrate 14. Although illustration is not made in FIG. 3, an output cable is drawn from the circuit elements via the shield cover 16.

The illustrated antenna unit 10 further comprises a non-feeding conductor wall 18 for cover the patch antenna 12 except for the upper surface 122*u*. Specifically, the conductor wall 18 is apart from the side surface 122*s* and the bottom surface 122*d* of the dielectric 122 to as to cover the side surface 122*s* and the bottom surface 122*d* of the dielectric 122. The conductor wall 18 is, for example, made of metal. However, the conductor wall 18 is not restricted to metal. The conductor wall 18 serves as a ground plate (earth plate).

The illustrated conductor wall 18 has a length, a width, and a thickness which are equal to 60 mm, 60 mm, and 10 mm, respectively. The conductor wall 18 comprises a square main conductor plate 182 for mounting the shield cover 16, four side plates 184 extending upward from four sides of the main conductor plate 182, and four trapezoidal tongue pieces 186 extending inward from upper ends of the four side plates 184 in parallel with the main conductor plate 182. That is, the main conductor plate 182 is apart from the bottom surface 122*d* of the patch antenna 12.

The main conductor plate 182 has a size of a length of 60 mm and a width of 60 mm. Each side plate 184 has a size of a length of 60 mm and a height of 10 mm. Each trapezoidal tongue piece 186 has a trapezoidal height of 8 mm. As shown in FIG. 3, the four trapezoidal tongue piece 186 lie on a surface which is substantially equal to the top surface 122*u* of the dielectric 122.

Figure 4:
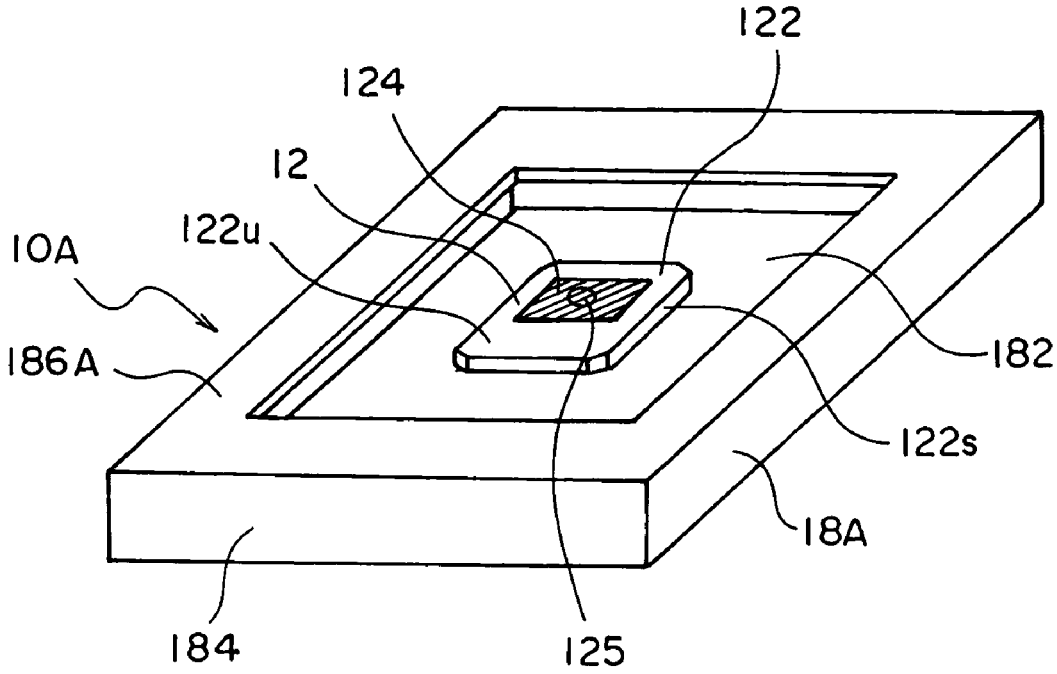
FIG. 4 is a perspective view of an antenna unit according to a second embodiment of this invention.
Figure 5:
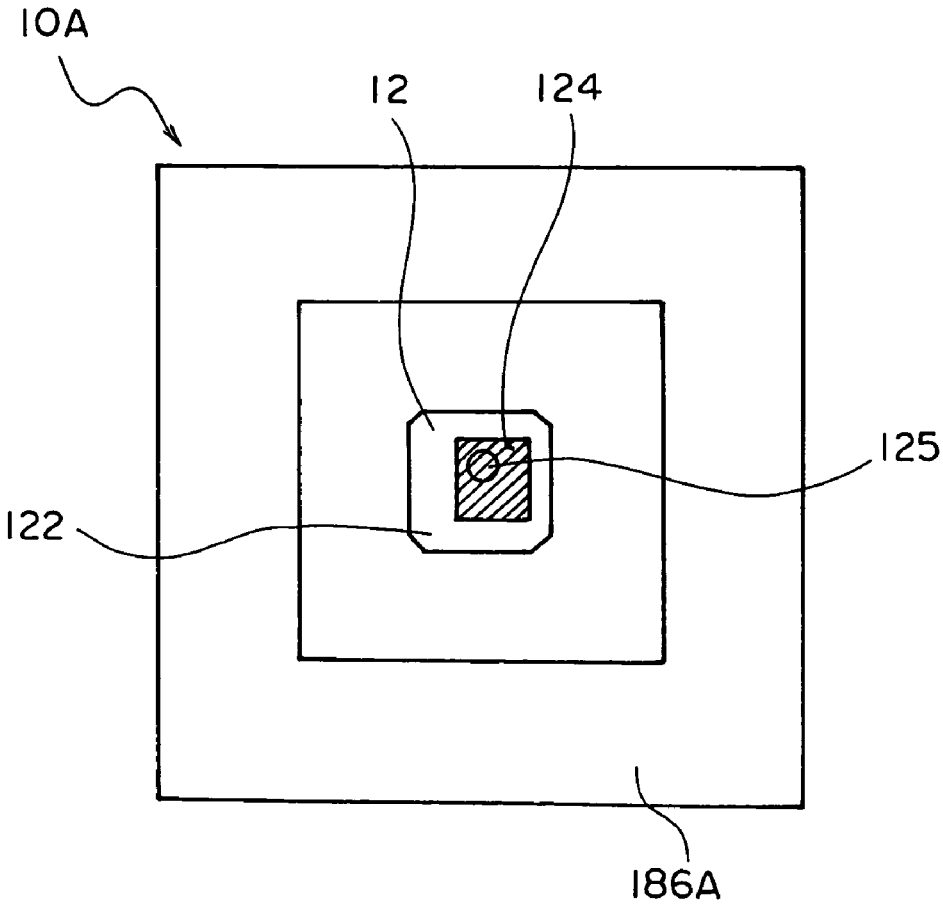
FIG. 5 is a plan view of the antenna unit illustrated in FIG. 4.

Referring to FIGS. 4 and 5, the description will proceed to an antenna unit 10A according to a second embodiment of the present invention. FIG. 4 is a perspective view of the antenna unit 10A. FIG. 5 is a plan view of the antenna unit 10A.

The illustrated antenna unit 10A is similar in structure to the antenna unit 10 illustrated in FIGS. 1 to 3 except that the conductor wall is modified from that illustrated in FIGS. 1 to 3 as will later become clear. Accordingly, the same reference symbols are attached to those having similar functions in FIGS. 1 to 3 and description thereof will be omitted for simplification of the description. The conductor wall is therefore depicted at 18A.

The conductor wall 18A is similar in structure to the conductor wall 18 except that the conductor wall 18A comprises a ring-shaped top plate 186A in place of the four trapezoidal tongue pieces 186. The ring-shaped top plate 186A extends inward from upper ends of the four side plates 184 in parallel with the main conductor plate 182. The ring-shaped top plate 186A has a width of 8 mm.

FIG. 6 shows an antenna radiation characteristic of a conventional antenna unit including only the patch antenna 12 without the conductor wall. FIG. 7 shows an antenna radiation characteristic of the antenna unit 10 illustrated in FIGS. 1 through 3. FIG. 8 shows an antenna radiation characteristic of the antenna unit 10A illustrated in FIGS. 4 and 5. Each of FIGS. 6 and 8 shows an average gain Ave. (dBi), a maximum gain Max. (dBi), and a minimum gain Min. (dBi) for the satellite wave SAT in a case where the angle of elevation is equal to 20 degrees, 25 degrees, 30 degrees, 35 degrees, 40 degrees, 45 degrees, 50 degrees, 55 degrees, and 60 degrees and the average gain Ave. (dBi), the maximum gain Max. (dBi), the minimum gain Min. (dBi), and a difference Max.-Min. between the maximum gain and the minimum gain for the terrestrial wave TER having the angle of elevation of 0 degree.

From FIGS. 6 through 8, in a low angle of elevation which is 45 degree or less, it is understood that the antenna units 10 and 10A according to this invention have the average gain which is larger than that of the conventional antenna unit.

According to this invention, inasmuch as the conductive wall 18 or 18A is mounted so as to enclose the patch antenna 12, it is possible to ensure the directivity of the antenna in the low angle of elevation although the plate has a narrow area.

While this invention has thus far been described in conjunction with a few preferred embodiments thereof, it will now be readily possible for those skilled in the art to put this invention into various other manners. For example, the conductor wall may have various structures without restricting to those in the above-mentioned embodiments. The conductor wall may be made of any material having conductivity without restricting to that made of metal.

What is claimed is:

1. An antenna unit comprising:

a circuit substrate having an upper surface and a bottom surface;

a patch antenna mounted on the upper surface of the circuit substrate, said patch antenna comprising: a dielectric having a top surface, a bottom surface, and a side surface, a radiation element formed on the top surface of said dielectric, and a ground conductor formed on the bottom surface of said dielectric;

a shield cover attached to the bottom surface of the circuit substrate; and a non-feeding conductor wall on which the shield cover is mounted, and which is apart from the side surface and the bottom surface of said dielectric and covers the side surface and the bottom surface of said dielectric.

2. The antenna unit as claimed in claim 1, wherein said conductor wall is made of metal.

3. The antenna unit as claimed in claim 1, wherein said conductor wall comprises:

a square main conductor plate opposite to the bottom surface of said dielectric;

four side plates respectively corresponding to and extending upward from four sides of said main conductor plate; and four trapezoidal tongue pieces respectively corresponding to and extending inward from upper ends of said four side plates in parallel with said main conductor plate.

4. The antenna unit as claimed in claim 1, wherein said conductor wall comprises:

a square main conductor plate opposite to the bottom surface of said dielectric;

four side plates respectively corresponding to and extending upward from four sides of said main conductor plate; and a ring-shaped top plate extending inward from upper ends of said four side plates in parallel with said main conductor plate.

* * * * *